United States Patent [19]

Thorneburg

[11] 4,194,249

[45] Mar. 25, 1980

[54] JOGGING AND RUNNING ATHLETIC SOCK

[75] Inventor: James L. Thorneburg, Statesville, N.C.

[73] Assignee: Thorneburg Hosiery Co., Inc., Statesville, N.C.

[21] Appl. No.: 12,072

[22] Filed: Feb. 14, 1979

[51] Int. Cl.[2] ..... A41B 11/00

[52] U.S. Cl. ..... 2/239; 66/182

[58] Field of Search ..... 2/239, 61; 36/10; 66/171, 178 R, 182, 185, 187

[56] References Cited

U.S. PATENT DOCUMENTS

| | | | |
|---|---|---|---|
| 2,144,563 | 1/1939 | Davis | 66/182 |
| 3,503,077 | 3/1970 | Connelly | 2/239 |
| 3,990,115 | 11/1976 | Nester | 2/239 |
| 4,038,699 | 8/1977 | Burn | 2/239 |

*Primary Examiner*—H. Hampton Hunter

*Attorney, Agent, or Firm*—Bell, Seltzer, Park & Gibson

[57] ABSTRACT

The present athletic sock is particularly suitable for jogging and running and is provided with terry loop shock absorber cushions in the heel and ball areas to form a relatively great terry loop density for protecting and cushioning the heel and ball areas of the foot of the wearer. Relatively lesser terry loop density is provided in the arch area to reduce the shock normally imparted to the arch of the foot of the wearer so that normal articulation of the bones in the foot takes place when the wearer is jogging and running. The shock absorber cushions are formed by providing a greater density of terry loops in the heel and ball areas of the sock than in the arch area to enhance the cushioning provided in the ball and heel areas.

6 Claims, 16 Drawing Figures

JOGGING AND RUNNING ATHLETIC SOCK

FIELD OF THE INVENTION

This invention relates generally to an athletic sock particularly suitable for jogging and running and more particularly to such a sock provided with terry loop shock absorber cushions in the heel and ball areas and with relatively less terry loop density in the arch area for enhancing the cushioning provided to the heel and ball of the foot of the wearer.

BACKGROUND OF THE INVENTION

It has been the practice for many years to provide athletic type socks with a terry loop "cushion" sole in which the same type and density of terry loops extend throughout the length of the lower sole portion of the sock to provide the same type of terry loop cushioning, protection and moisture absorbency throughout the entire length of the lower portion of the foot of the wearer. When taking part in athletic activities, such as jogging and running, the cartilages joining the bones in the arch of the foot provide elasticity and the arch tends to flatten each time the foot impacts on the surface. When the known type of sock with the same type of terry loop cushioning throughout the length of the sole in worn with a shoe provided with an arch support, the flattening of the arch results in the arch receiving a major portion of the shock of the impact so that the effectiveness of the terry loop cushioning in the heel and ball areas is reduced.

Additionally, it is known to provide the same type of terry loop cushioning in certain selected areas of the foot of a sock, for example in the manner illustrated in the Davis U.S. Pat. No. 2,144,563. However, this patent discloses providing the same type of terry loops throughout the arch and ball areas and does not solve the main problem encountered by joggers and runners because it does not recognize the need for a lesser amount of cushioning or padding in the arch area relative to that provided in the ball and heel areas so that the full benefit of the greater amount of cushioning in the heel and ball areas is available to absorb the shock applied against the corresponding ball and heel areas of the foot of a jogger or runner.

SUMMARY OF THE INVENTION

With the foregoing in mind, it is an object of the present invention to provide an athletic sock particularly suitable for jogging and running with terry loop shock absorber cushions in the heel and ball areas for protecting and cushioning the heel and ball of the foot of the wearer and with a lesser amount of cushioning or terry loop density in the arch area so that the greater amount of terry loop density in the heel and ball areas is more effective in protecting and cushioning the corresponding portions of the foot of the wearer.

The terry loop cushioning in the sock of the present invention eliminates the need for separate heel and sole pads because the shock absorber cushions of greater terry loop density are knit as an integral part of the sock. The terry loop cushioning in the present sock provides cushioning and support of the foot bones in the normal and correct position so that relief is provided from discomfort incident to strains and pressures on the bones, ligaments, tissues, nerves and the cartilages joining the foot bones. The shock absorber cushions of greater terry loop density in the ball and heel areas are positioned to absorb, diffuse and reduce the shock and jar normally applied by a jogger or runner to the calcaneus or heel bone and to the juncture of the phalanges and metatarsal bones located in the ball area of the foot. By relieving the shock normally applied in these two areas, the shock, strain and pressure normally transmitted to the remaining bones of the foot are also reduced so that normal articulation of the bones in the foot takes place when jogging or running.

In one embodiment of the sock of the present invention, the arch area is provided with terry loops knit of a single terry yarn to provide a relatively thin or less dense cushioned area of lesser terry loop density in the arch while a pair of terry yarns forms terry loops in the heel and ball areas so that these corresponding areas include greater terry loop density and provide additional cushioning and protection to the corresponding heel and ball areas of the foot of the wearer.

In another embodiment of the sock of the present invention, the arch area is knit of body yarn and is devoid of terry loops to reduce the weight of the sock and the heel and ball areas of the sock include terry loops to provide cushioned areas for protecting the corresponding heel and ball areas of the foot of the wearer.

The jogging and running sock of the present invention may be of the low-cut type, may be of a medium height with a cuff extending to the ankle, or may be provided with a longer leg so that the cuff is positioned below or above the knee. The sock is manufactured in these different styles for wear in different seasons of the year. Also, the prospective buyer is provided with several styles from which to choose, depending upon the particular preference of the buyer.

The provision of a greater terry loop density in the heel and ball areas with a lesser terry loop density in the arch area of the present sock insures that the full benefit of the terry loop shock absorber cushions in heel and ball areas is available to be applied to the corresponding portions of the foot of the wearer. This type of shock absorbing cushioning is more effective than that provided in the presently available type of athletic sock in which the entire heel, arch and toe areas include the same type of terry loop cushioning throughout. With the same density of terry loops extending throughout the sole, the cushioned arch area supports and cushions the arch to the same degree as the heel and ball of the foot so that the ball and heel do not receive the full benefit of the cushioning. On the other hand, the reduction, or elimination, of the terry loops in the arch area, in accordance with the sock of the present invention, provides lesser terry loop density so that the support and cushioning in the arch area is reduced and the full benefit of the shock absorber cushions of greater terry loop density is provided in the ball and heel areas.

BRIEF DESCRIPTION OF THE DRAWINGS

Other objects and advantages will appear as the description proceeds when taken in connection with the accompanying drawings, in which—

DESCRIPTION OF THE EMBODIMENT ILLUSTRATED IN FIGS. 1-8

Figure 1:
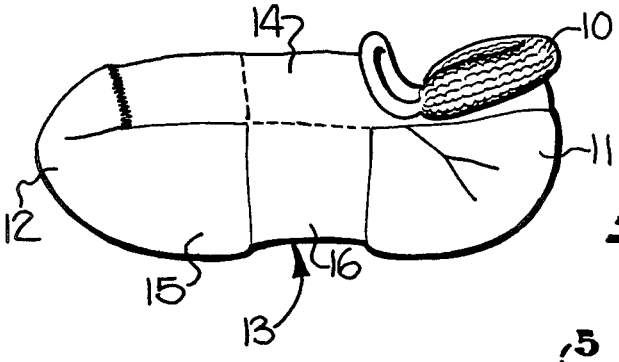
FIG. 1 is a side elevational view of one embodiment of the sock of the present invention and being shown in flattened condition.
Figure 2:
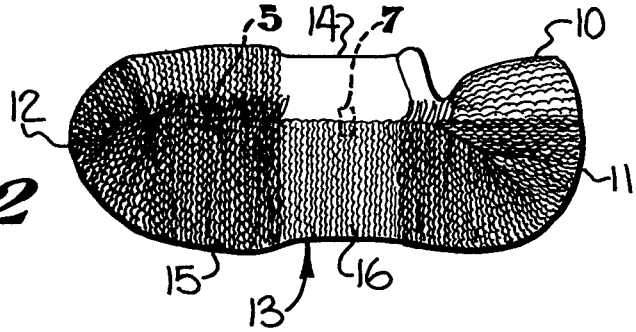
FIG. 2 is a view similar to FIG. 1 but illustrating the sock in everted condition with the terry loops in the cushioned areas facing outwardly.
Figure 3:
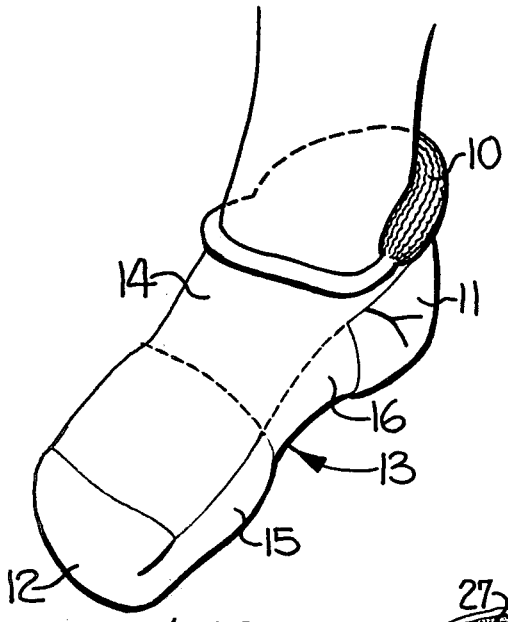
FIG. 3 is a perspective view of the sock as it appears when positioned on the foot of a wearer.

The sock illustrated in FIGS. 1-8 is of the type generally referred to as a low-cut or within-the-shoe sock. Generally, this sock is knit in accordance with my prior U.S. Pat. No. 3,274,804 and includes an upper foot receiving roll top opening 10 which is adapted to extend coterminously with the upper edge of a jogging or running shoe. As disclosed in my prior patent, the upper edge or top of the opening 10 is provided with elastic yarn to cause the upper edge to roll down upon itself and form an enlarged roll around the rear of the heel of the wearer, as illustrated in FIG. 3.

The foot of the sock includes a reciprocatorily knit heel area or pocket 11 provided with terry loops, formed in a manner to be presently described. The foot of the sock also includes a reciprocatorily knit toe portion or pocket 12, an integrally knit lower sole, broadly indicated at 13, which connects the heel pocket 11 and the toe pocket 12, and an upper instep 14. The sole 13 encompasses substantially one-half the lower circumference of the foot and the instep 14 encompasses substantially one-half the circumference of the upper portion of the foot. The sole 13 includes a ball terry area 15 positioned adjacent to the toe pocket 12 and extending toward the heel pocket 11. The ball area 15 extends not over about one-half the distance between the heel pocket 11 and the toe pocket 12. The sole 13 also includes an arch terry area 16 positioned intermediate the ball area 15 and the heel pocket 11 and extending rearwardly from the ball area 15 and to a position closely adjacent the heel pocket 11.

The sock is knit throughout of one or more suitable body yarns, indicated in FIGS. 5-8 as a single plain yarn B. A first terry yarn, indicated at T-1 and speckled for identification, is knit with the body yarn B and forms a first set of terry loops thoughout the sock, except for the upper portion of the instep 14 which is positioned opposite the arch area 16. The successive courses of the knit fabric of FIGS. 5 and 7 extend in a vertical direction and the needle wales, indicated at W-1, W-2 and W-3, extend in a horizontal direction with the sinker wales, in which the terry loops are formed, aligned between the needle wales.

Figure 5:
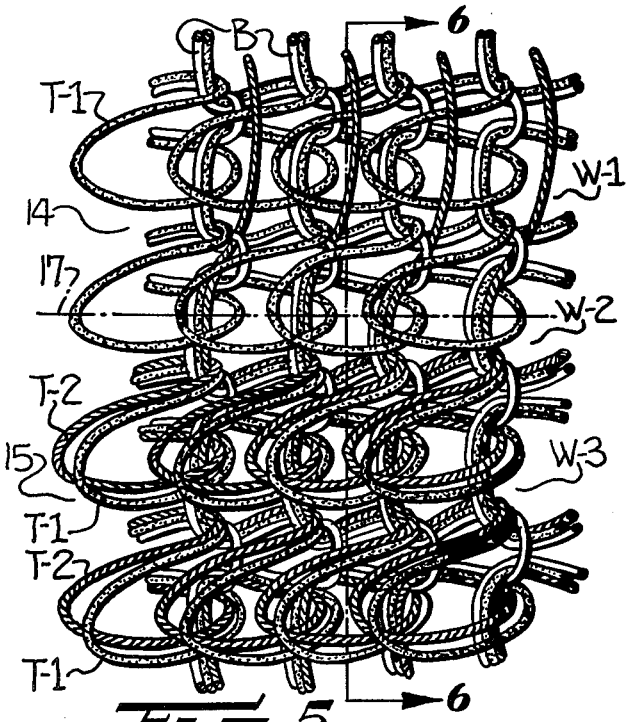
FIG. 5 is a greatly enlarged elevational view of a small area of the knit fabric, being taken substantially in the dotted rectangle area 5 in FIG. 2, and illustrating the manner in which the first and second terry yarns form first and second sets of terry loops and are incorporated with the body yarn.
Figure 6:
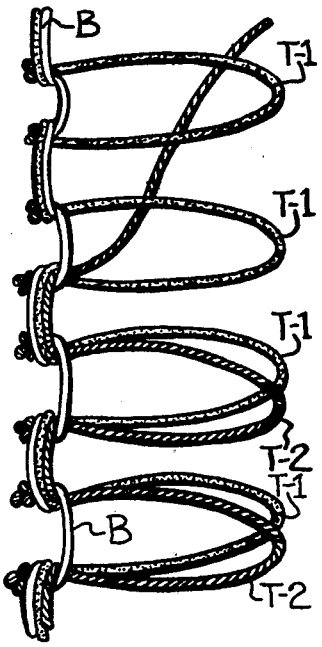
FIG. 6 is a vertical sectional view taken along the line 6—6 in FIG. 5 and illustrating the more dense or greater number of terry loops in the ball area.
Figure 7:
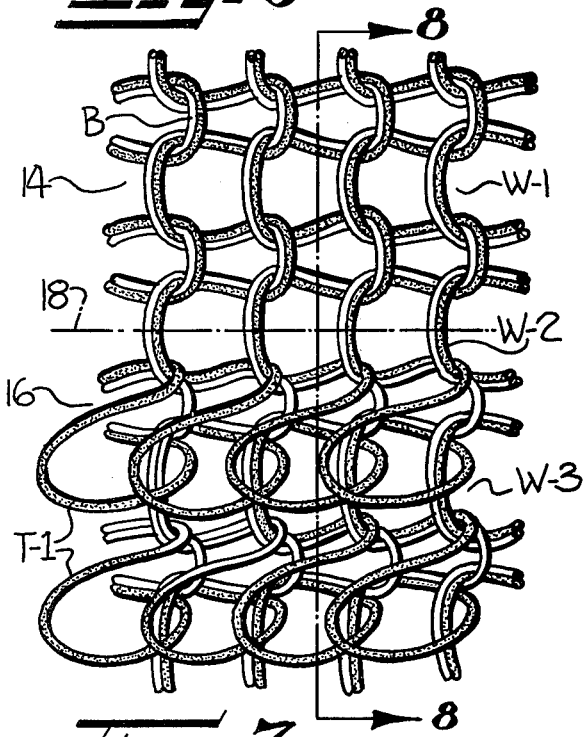
FIG. 7 is a view similar to FIG. 5 but being taken in the area of the dotted rectangle 7 in FIG. 2 and illustrating the manner in which the single terry yarn forms a single set of terry loops in the arch area and is knit in plated relationship with the body yard in the upper instep so that terry loops are not formed in the upper instep portion of the sock.
Figure 8:
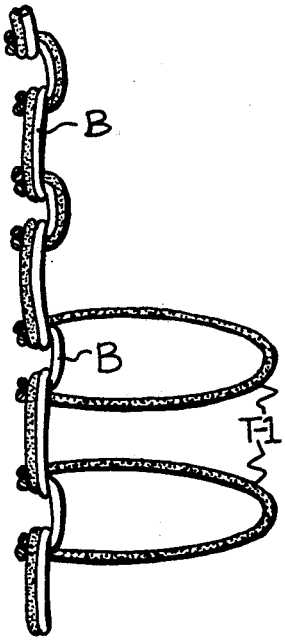
FIG. 8 is a vertical sectional view taken along the line 8—8 in FIG. 7.

The first terry yarn T-1 is knit in plated relationship with the body yarn B in the needle wales and forms a first set of terry loops in the sinker wales in both the ball area 15 (below the horizontal dash-dot line in FIG. 5) and the forward portion of the instep 14 (above the horizontal dash-dot line 17 in FIG. 5). The first terry yarn T-1 also forms terry loops in the sinker wales of the arch area 16 (below the horizontal dash-dot line 18 in FIG. 7) but is knit in plated relationship with the body yarn B in the sinker wales in the rear portion of the instep 14 (above the horizontal dash-dot line 18 in FIG. 7). Thus, the first terry yarn T-1 does not form terry loops in the portion of the instep 14 which is opposite the arch area 16, as illustrated between the needle wales W-1 and W-2 of FIG. 7.

A second terry yarn, indicated at T-2 and striped for identification in FIGS. 5-8, is knit with the body yarn B and forms a second set of terry loops, as illustrated below the dash-dot line 17 in FIG. 5. The second set of terry loops is formed in the heel pocket 11, the lower half of a few of the complete courses adjacent the heel pocket 11 and adjacent the arch area 16, in the ball area 15, and in the toe pocket 12. The second terry yarn T-2 is fed to the needles through what is known as a "chopping" yarn feed finger and is fed to and removed and cut adjacent opposite sides of the lower half of the few complete courses adjacent the heel pocket 11, as illustrated in FIG. 2, and in the ball area 15, as illustrated in FIGS. 2 and 5, so that the second terry yarn T-2 is not incorporated in the corresponding portion of the instep 14 opposite the arch area 16 and in the forward portion of the instep opposite the ball area 15.

The second terry yarn T-2 is also knit in plated relationship with the body yarn B and forms a second set of terry loops in the reciprocatorily knit heel pocket 11 and toe pocket 12. During the knitting of the heel pocket 11 and the toe pocket 12, the second terry yarn T-2 is also fed to the needles through the chopping yarn feed finger but it is not necessary to feed and remove the second terry yarn because only the needles which knit are in active position while the usual narrowing and widening operations are carried out in knitting the heel pocket 11 and toe pocket 12.

In the knit fabric shown in FIGS. 5–8, the body yarn B, the first terry yarn T-1 and the second terry yarn T-2 are illustrated as being of substantially the same size and the stitch structure is shown very open, for purposes of clarity. However, in the actual sock, the knit stitch loops contract and are very small and the terry yarns T-1 and T-2 are usually larger and bulkier than the body yarn B. The loose loops of the terry loops are free to relax so that the bulk in the yarn is developed, during finishing, and the terry loops are thicker, more dense and more crowded together than illustrated in FIGS. 5–8. Even when a single set of terry loops is formed in an area, such as in the arch area 16, a fairly dense compact cushion is formed and when the second set of terry loops is added, such as in the ball area 15, the terry loops are packed closer together and are more concentrated to form a much denser concentration of terry loops.

There are twice the number of terry loops formed in a given area of the ball area 15 and heel area 11 as the number of terry loops formed in the same area of the arch area 16 so that the terry loop density in the arch area 16 is less than the terry loop density in the ball area 15 and the heel area 11. When an attempt is made to compress the terry loops in the areas which include two sets of terry loops, there are so many terry loops packed into such a small area that they cannot lean over and flatten as easily as those areas where only a single set of terry loops is formed.

Thus, the first and second sets of terry loops in the heel 11, the portion adjacent thereto and adjacent the arch area 16, the ball area 15 and the toe pocket 12, form respective shock absorber cushions of greater terry loop density and provide a greater amount of cushioning or padding in the heel, ball and toe areas than in the arch area 16, where only a single set of terry loops is formed. The extra set of terry loops in the heel, ball and toe areas thus provide thicker or more dense cushioned additional shock absorber cushions in the heel, toe and ball areas, as schematically illustrated at 11*a*, 12*a* and 15*a* in FIG. 4. The areas of lesser terry loop density in the arch 16 and forward portion of the instep 14 are schematically illustrated in FIG. 4 at 16*a* and 14*a*.

The more dense terry loops forming the respective shock absorber cushions 11*a* and 15*a* (FIG. 4) in the heel 11 and ball 15 are provided in the areas of the foot where the greatest protection is needed when jogging and running. The initial shock at impact occurs at the heel, where the heel or calcaneus bone, indicated at 20 in FIG. 4, extends downwardly. The heel or calcaneous bone 20 is positioned beneath the talus bone 21 and at the lower end of the tibia 22. The other main bones in the foot include the navicular 23, the cuneiform 24, the metatarsals 25, the phalanges 26, and the toe bones 27.

Figure 4:
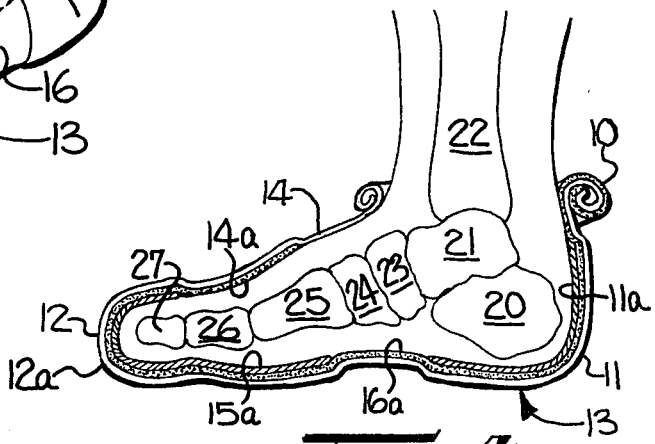
FIG. 4 is a longitudinal sectional view of the sock on the foot and schematically illustrating the areas of additional or more dense terry loop cushioning or padding provided in the heel, ball and toe areas of the sock.

As illustrated in FIG. 4, the more dense terry loops forming the shock absorber cushion 15*a* is positioned beneath the ball of the foot and at the juncture of the phalanges 26 and the metatarsals 25. When the foot impacts against the surface, the cartilages joining the bones in the arch, particularly the talus 21, the navicular 23, the cuneiform 24, and the upper ends of the metatarsals 25 provide elasticity and the arch tends to flatten so that the lower portion of the arch of the foot would normally receive a major portion of the shock of the impact, when the shoe is provided with the proper type of arch support, and if the same type of terry loop cushioning were provided throughout the length of the sole of the wearer. Since the arch area 16 of the sock of the present invention is provided with relatively less terry loop density than the heel area 11 and the ball area 15, a slight flattening of the arch during each impact does not reduce the effectiveness of the greater terry loop density in the shock absorber cushions 11*a* and 15*a* in the respective heel area 11 and ball area 15. The terry yarns T-1 and T-2 and the body yarn B may be of the same or different colors and either or both of the terry yarns may be plated with the body yarn so that they appear on the outer surface of the sock.

DESCRIPTION OF THE EMBODIMENT ILLUSTRATED IN FIGS. 9–11

Figure 9:
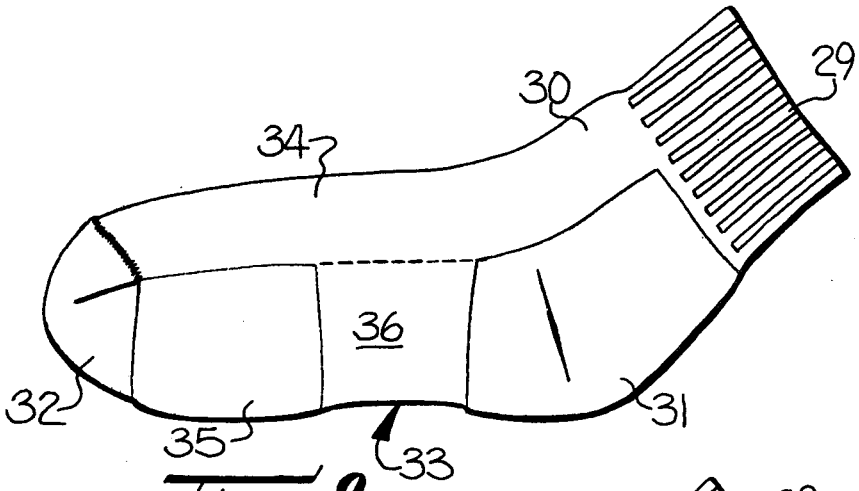
FIG. 9 is a side elevational view of another embodiment of the sock of the present invention.
Figure 10:
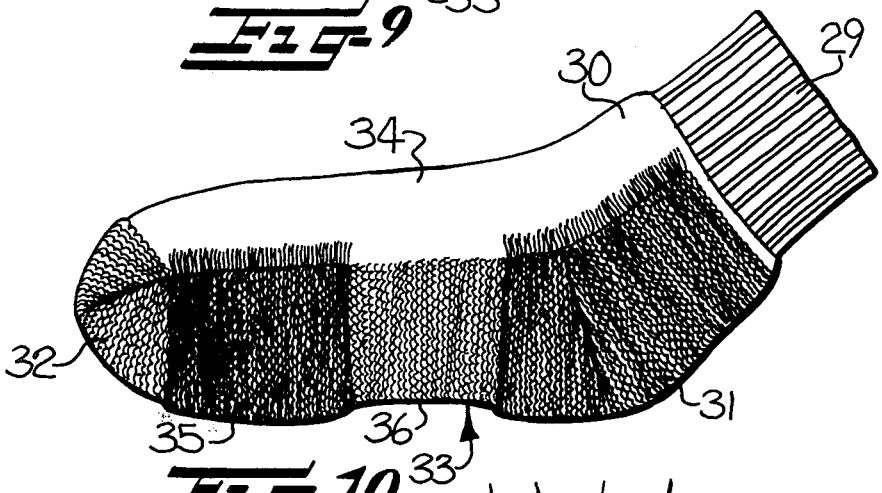
FIG. 10 is a view similar to FIG. 9 but illustrating the sock in everted condition with the terry loops in the cushioned areas positioned on the outer surface thereof.
Figure 11:
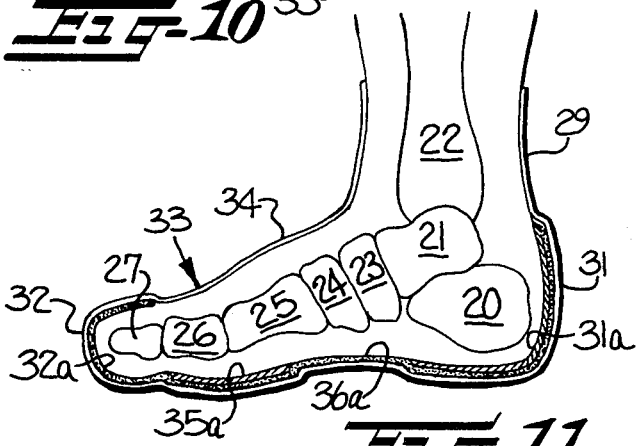
FIG. 11 is a longitudinal sectional view through the sock with the sock positioned on the foot of the wearer and schematically illustrating the areas of additional or more dense terry loop cushioning or padding in the heel and ball areas.

The sock illustrated in FIGS. 9–11 is of the type generally referred to as an anklet in which a short leg is provided and the cuff extends to cover the ankle. The sock includes a cuff 29 and a relatively short leg portion 30, extending from the lower edge of the cuff 29 and to a reciprocatorily knit heel pocket 31. The foot of the sock also includes a reciprocatorily knit toe pocket 32 and an integrally knit lower sole, broadly indicated at 33, which connects the heel pocket 31 and the toe pocket 32, and an upper instep 34. The sole 33 encompasses substantially one-half the lower circumference of the foot and the instep 34 encompasses substantially one-half the circumference of the upper portion of the foot. The sole 33 includes a ball terry area 35 positioned adjacent to the toe pocket 32 and extending toward the heel pocket 31. The ball area 15 extends not over about one-half the distance between the heel 31 and the toe 32. The sole 33 also includes an arch terry area 36 which extends rearwardly from the ball area 35 and to a position closely adjacent the heel pocket 31.

Like the sock illustrated in FIGS. 1–8, the sock illustrated in FIGS. 9–11 is knit throughout of a suitable body yarn and a first terry yarn is knit with the body yarn and forms a first set of terry loops extending throughout the sock, except for the upper portion of the leg 30 and the instep 34. The first terry yarn is knit in plated relationship with the body yarn and does not form terry loops in the instep 34 and front portion of the leg 30 but does form terry loops in the rear portion of the leg 30, the heel pocket 31, the arch 36, and the toe pocket 32. A second terry yarn is also knit in plated relationship with the body yarn and forms a second set of terry loops in the rear portions of the courses of the leg 30, in the heel pocket 31, in the lower halves of a few of the ring courses following the heel pocket 31, and in the ball area 35. The second terry yarn is not knit in the front portions of the courses of the leg 30, the upper half of the few ring courses adjacent the heel pocket 31, and the instep 34 adjacent the ball area 35, but is removed and clipped at opposite sides of these areas, as illustrated in FIG. 10.

The areas of greater terry loop density forming the terry loop shock absorber cushions are schematically illustrated at 31*a* and 35*a* in FIG. 11 and are illustrated as extending beneath the heel or calcaneus bone 20 and the ball of the foot of the wearer, where the phalanges 26 and the metatarsals 25 join. The areas of lesser terry loop density in the arch 36 and the toe pocket 32 are schematically illustrated at 36*a* and 32*a* in FIG. 11. Thus, the greater amount of cushioning or padding is provided in these areas where the greatest shock is received when running or jogging. The instep area 36 and toe area 32 have a single set of terry loops to provide lesser terry loop density than the greater terry loop density provided in the heel and ball areas while the upper portion of the sock is devoid of terry loops.

Like the sock in the embodiment of FIGS. 1–8, the sock of FIGS. 9–11 has lesser terry loop density in the arch area 36 than the terry loop density in the ball area 35 and the heel area 31 so that respective shock absorber cushions of greater terry loop density are provided in the ball area 35 and the heel area 31. The shock absorber cushions enhance the cushioning provided in the ball and heel of the foot of the wearer because the lesser terry loop density in the arch area 36 reduces the shock normally imparted to the arch of the foot of the wearer. This permits the normal articulation of the bones in the foot to take place when the wearer of the present sock is jogging and running.

DESCRIPTION OF THE EMBODIMENT ILLUSTRATED IN FIGS. 12–16

The sock illustrated in FIGS. 12–16 is of the same general type as that illustrated in FIGS. 9–11 except that it is provided with a longer cuff and may be provided with a longer leg area, if desired. The leg may be long enough that the cuff extends immediately below or even above the knee of the wearer. The sock includes a cuff 39, joined at the lower end to the upper end of a leg portion 40. The foot includes a reciprocatorily knit heel pocket 41 at the lower end of the leg 40 and a reciprocatorily knit toe pocket 42. The foot also includes an integrally knit lower sole, broadly indicated at 43, which connects the heel pocket 41 and the toe pocket 42, and an upper instep 44. The sole 43 encompasses substantially one-half the lower circumference of the foot and the instep 44 encompasses substantially one-half the circumference of the upper portion of the foot. The sole 43 includes a ball area 45 positioned adjacent to the toe pocket 42 and extending toward the heel pocket 41. The ball area 45 extends not over about one-half the distance between the heel 41 and the toe 42. The sole 43 also includes an arch area 46 which extends rearwardly from the ball area 15 and to a position closely adjacent the heel pocket 41.

The sock illustrated in FIGS. 12–16 may be termed a running sock since it includes either a single or double set of terry loops in the heel pocket 41 and adjacent areas, in the lower half of the toe pocket 42, and in the ball area 45, but does not contain terry loops in the remaining areas so that this sock is generally lighter in weight than the first two embodiments illustrated. This lightweight sock includes a fairly lightweight body yarn, indicated at B in FIG. 16. The body yarn B is knit throughout the sock and a first terry yarn, indicated at T-1, is knit with the body yarn B and forms a first set of terry loops in the rear portions of the full courses of the leg 40, in the heel pocket 41, in the lower portions of a few ring courses following the heel pocket 41, in the ball area 45, and in the lower half of the toe pocket 42.

If desired, only one terry yarn may be used to form a single set of terry loops in the cushioned heel area 41 and ball area 45, while no terry loops are formed in the arch area 46. If additional cushioning is desired, a second terry yarn, indicated at T-2 in FIGS. 15 and 16, may also be knit in plated relationship with the body yarn in the heel area 41 and the ball area 45 so that a second set of terry loops is formed in these areas.

Figure 12:
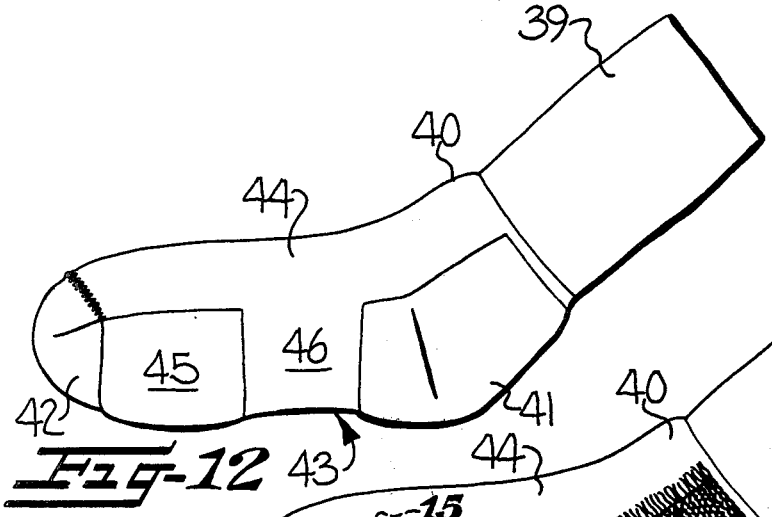
FIG. 12 is a side elevational view of another embodiment of the sock of the present invention.
Figure 13:
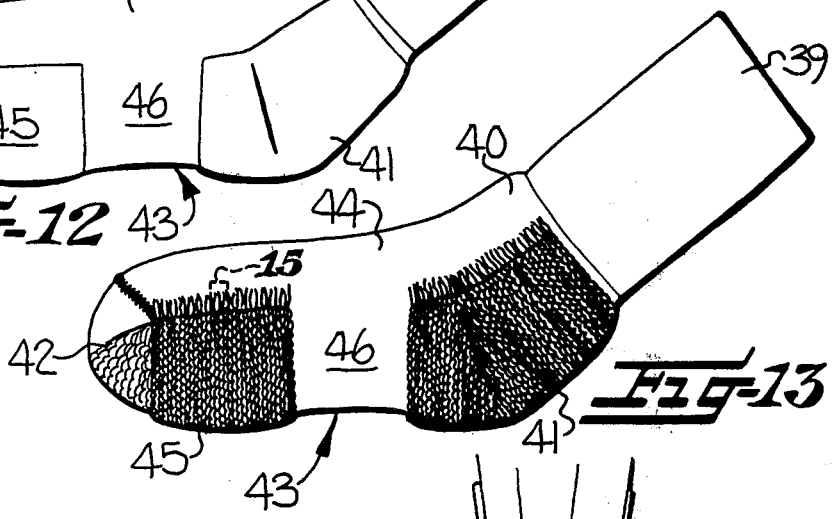
FIG. 13 is a view similar to FIG. 12 but illustrating the sock in everted condition with the terry loops in the cushioned areas positioned on the outer surface thereof.
Figure 14:
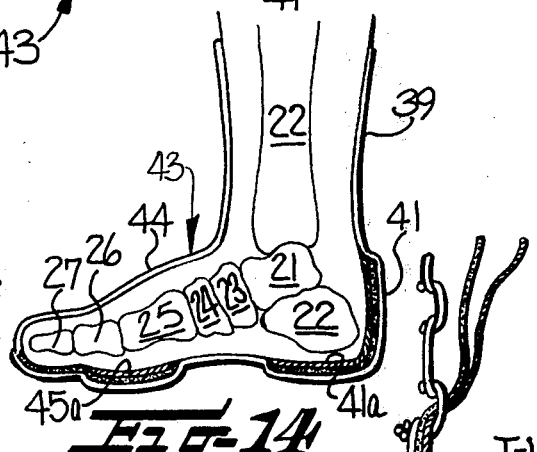
FIG. 14 is a longitudinal sectional view through the sock as it appears when worn and schematically illustrating the areas of additional or more dense terry loop cushioning or padding in the heel and ball of the sock.
Figure 15:
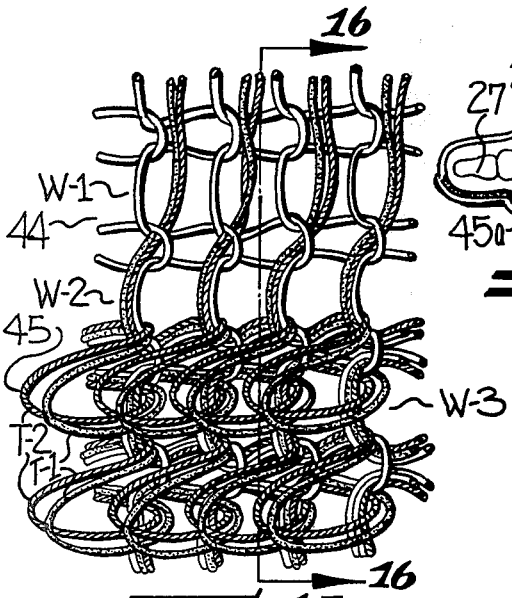
FIG. 15 is a greatly enlarged fragmentary elevational view taken substantially in the area of the dotted rectangle area 15 in FIG. 14 and illustrating the manner in which two terry yarns form two sets of terry loops in the ball area and with the ends of both terry yarns being cut so that only the body yarn is knit in the upper instep area of the sock.
Figure 16:
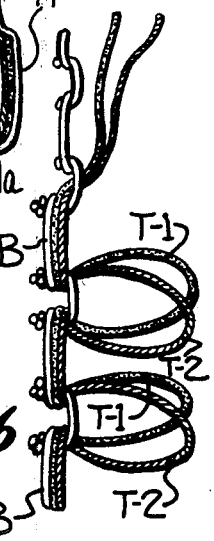
FIG. 16 is a vertical sectional view taken along the line 16—16 in FIG. 15.

As illustrated in FIG. 15, both of the terry yarns T-1 and T-2 are removed adjacent opposite sides of the areas in which they are knit and they are cut adjacent opposite sides of these areas to leave free ends inside of the sock, as illustrated in FIG. 13. In the first two embodiments, the first terry yarn T-1 was not cut but was knit in plated relationship with the body yarn without forming terry loops in the areas opposite the areas around the heel pocket and in the area opposite the ball area. However, in the sock of FIGS. 12–16, both the first and second terry yarns T-1 and T-2 are fed through chopping fingers and both are cut adjacent opposite sides of the terry loop areas.

The terry loops in the heel pocket 41 and adjacent areas and the ball area 45 thus provide shock absorber cushions of relatively greater terry loop density in the heel and ball areas while no terry loops are provided in the arch area 46, where only the body yarn is knit, so that the terry loop density in the arch area 46 is relatively less than the terry loop density in the ball area 45 and the heel area 41.

As schematically illustrated in FIG. 14, a shock absorber cushion **41*a* is provided beneath the heel bone 20 and a shock absorber cushion 45*a* is provided at the juncture of the phalanges 26 and the metatarsals 25 so that the ball of the foot is protected as well as the heel when the foot impacts against the surface. The lesser terry loop density in the arch area 46 enhances the cushioning provided in the ball area 45 and the heel area 41** because the shock normally imparted to the arch of the foot of the wearer is reduced.

While three particular embodiments of socks have been illustrated and described, it is to be understood that these particular illustrated embodiments may be varied, depending upon the particular need. For example, the arch area 16 may be devoid of terry loops and the foot opening 10 may be provided with any length of leg. The terry loops in the forward portion of the instep 14 may be eliminated, or terry loops may be added in the rear portion of the instep 14.

The terry loops in the arch area 36 of the sock shown in FIG. 9 may be eliminated. A single set of terry loops may be formed in any desired portion of the upper instep 34 and the sock may be provided with a different length of leg, or may be provided with a roll top foot opening of the type shown in FIG. 1.

In the sock of FIG. 12, only a single set of terry loops may be provided in the heel pocket 41 and ball area 45. Also, a single set of terry loops may be provided in the arch area 46, as well as in any selected portion of the upper instep 44.

In the drawings and specification there have been set forth preferred embodiments of the invention, and although specific terms are employed, they are used in a generic and descriptive sense only and not for purposes of limitation, the scope of the invention being defined in the claims.

That which is claimed is:

1. An athletic sock including ball, arch and heel terry areas and being particularly suitable for jogging and running by providing a greater amount of cushioning to the ball and heel than to the arch of the foot of the wearer, said sock being characterized by having a terry loop density in said arch area which is relatively less than the terry loop density in said ball and heel areas, said sock being knit throughout of body yarn, a first terry yarn knit with said body yarn and forming a first set of terry loops in said ball, arch and heel areas, and a second terry yarn knit with said body yarn and said first terry yarn in said ball and heel areas and forming a second set of terry loops in said ball and heel areas, whereby said first and second sets of terry loops in said ball and heel areas form respective shock absorber cushions of greater terry loop density in said ball and heel areas than the terry loop density in said arch area for enhancing the cushioning provided in said ball and heel areas by absorbing and distributing shock on the ball and heel of the foot of the wearer and thereby reducing the shock normally imparted to the arch of the foot of the wearer so that normal articulation of the bones in the foot takes place when jogging and running.

2. An athletic sock according to claim 1 including an instep area positioned opposite said ball and arch terry areas and adapted to extend over the top of the foot of the wearer, which instep area is devoid of said second terry yarn.

3. An athletic sock according to claim 2 wherein said instep area opposite said ball terry area includes terry loops formed from said first terry yarn.

4. An athletic sock according to claim 3 wherein said instep area opposite said arch terry area is devoid of terry loops.

5. An athletic sock including ball and heel terry areas and an arch area, said sock being particularly suitable for jogging and running and being characterized by providing a greater amount of cushioning to the ball and heel than to the arch of the foot of the wearer, said sock being knit throughout of body yarn, terry yarn knit with said body yarn and forming terry loops in said ball and heel terry areas, and said arch area being devoid of terry loops whereby said terry loops in said ball and heel areas form respective shock absorbing terry loop cushions for enhancing the cushioning provided in said ball and heel terry areas by absorbing and distributing the shock on the ball and heel of the foot of the wearer and thereby reducing the shock normally imparted to the arch of the foot of the wearer so that normal articulation of the bones in the foot takes place when jogging and running.

6. An athletic sock according to claim 5 including a second terry yarn knit with said body yarn and the other terry yarn and forming a second set of terry loops in said heel and ball terry areas.

* * * * *